US010283089B2

(12) United States Patent
Modrzyk et al.

(10) Patent No.: US 10,283,089 B2
(45) Date of Patent: May 7, 2019

(54) DISPLAY CONTROLLER

(71) Applicant: ARM Limited, Cambridge (GB)

(72) Inventors: Damian Modrzyk, Cambridge (GB); Pawel Duc, Cambridge (GB); Piotr Chrobak, Cambridge (GB); Michal Bogusz, Cambridge (GB); Daren Croxford, Cambridge (GB)

(73) Assignee: Arm Limited, Cambridge (GB)

( * ) Notice: Subject to any disclaimer, the term of this patent is extended or adjusted under 35 U.S.C. 154(b) by 98 days.

(21) Appl. No.: 14/727,016

(22) Filed: Jun. 1, 2015

(65) Prior Publication Data

US 2015/0356953 A1 Dec. 10, 2015

(30) Foreign Application Priority Data

Jun. 10, 2014 (GB) ..... 1410314.7
Dec. 15, 2014 (GB) ..... 1422302.8

(51) Int. Cl.

*G09G 5/36* (2006.01)
*G09G 5/14* (2006.01)
*G09G 5/393* (2006.01)
*G09G 5/12* (2006.01)

(Continued)

(52) U.S. Cl.

CPC ..... *G09G 5/363* (2013.01); *G09G 5/003* (2013.01); *G09G 5/006* (2013.01); *G09G 5/12* (2013.01); *G09G 5/14* (2013.01); *G09G 5/393* (2013.01); *G09G 5/395* (2013.01); *G09G 2340/02* (2013.01); *G09G 2340/0407* (2013.01); *G09G 2340/0492* (2013.01); *G09G 2340/12* (2013.01); *G09G 2360/02* (2013.01);

(Continued)

(58) Field of Classification Search

CPC ..... G09G 5/14; G09G 2340/02; G09G 5/363; G06T 1/60; G06T 11/00

See application file for complete search history.

(56) References Cited

U.S. PATENT DOCUMENTS 5,206,628 A * 4/1993 Kelleher ..... G06T 11/203 345/505
6,873,341 B1 * 3/2005 Adams ..... G06K 9/00456 345/629

(Continued)

FOREIGN PATENT DOCUMENTS

EP 2674939 12/2013
GB 2476338 6/2011

OTHER PUBLICATIONS

UK Search Report dated Dec. 12, 2014, UK Patent Application GB1410314.7.

(Continued)

*Primary Examiner* — Ryan M Gray
(74) *Attorney, Agent, or Firm* — Vierra Magen Marcus LLP

(57) ABSTRACT

A display controller comprises an input stage 20 operable to read at least one input surface, a composition stage 28 operable to compose plural input surfaces to generate a composited output surface, an output stage 30 operable to provide the composited output surface to a display for display, a scaling engine 31 operable to scale a composited output surface generated by the composition stage 28, and a write-out stage 32 operable to write a composited and/or scaled output surface to external memory.

26 Claims, 10 Drawing Sheets

(51) Int. Cl.
*G09G 5/00* (2006.01)
*G09G 5/395* (2006.01)

(52) U.S. Cl.
CPC ... *G09G 2360/06* (2013.01); *G09G 2360/128* (2013.01); *G09G 2360/18* (2013.01)

(56) References Cited

U.S. PATENT DOCUMENTS

| | | | | |
|---|---|---|---|---|
| 6,975,324 | B1 * | 12/2005 | Valmiki | G09G 5/06 345/547 |
| 8,862,823 | B1 * | 10/2014 | Glasco | G06F 12/0848 711/118 |
| 2002/0145611 | A1 * | 10/2002 | Dye | G09G 5/14 345/543 |
| 2005/0052441 | A1 | 3/2005 | Stevens | |
| 2007/0188506 | A1 | 8/2007 | Hollevoet | |
| 2009/0201306 | A1 * | 8/2009 | Dyke | G09G 5/395 345/545 |
| 2009/0262122 | A1 * | 10/2009 | Darsa | G09G 5/14 345/545 |
| 2013/0083047 | A1 | 4/2013 | Shamarao | |
| 2015/0116311 | A1 * | 4/2015 | Leung | G06T 15/005 345/419 |
| 2015/0310833 | A1 * | 10/2015 | Zhao | G09G 5/022 345/634 |

OTHER PUBLICATIONS

UK Search Report dated Oct. 22, 2015, UK Patent Application GB1422302.8.

Bergsagel, "Super high resolution displays empowered by the OMAP4470 mobile processor," Texas Instruments, Jan. 2012.

ARM Mali-DP500, available at: http://www.arm.com/products/multimedia/mali-display/mali-dp500.php, downloaded on Mar. 29, 2015.

Chen, "Android UI Internal: UI Composition with Hardware Composer," Feb. 15, 2014, available at: http://pierrchen.blogspot.co.uk/2014/02/android-graphic-composition-hardware.html.

Duc, "Secure Mobile Payments-Protecting display data in TrustZone-enabled SoCs with the Evatronix PANTA Family of Display Processors," available at: http://www.design-reuse.com/articles/30675/secure-mobile-payments-protecting-display-data-in-trustzone-anabled-soc.html, downloaded on Jun. 29, 2015.

Hutchison, et al., "THAM 16.7—Application of Second Generation Advanced Multi-Media Display Processor (AMDP2) in a Digital Micro-Mirror Array based HDTV," Consumer Electronics, 2001 IEEE.

Lyons, et al., "Multi-Display Composition: Supporting display Sharing for Collocated Mobile Devices," Human-Computer Interaction—INTERACT 2009, vol. 5726 of the series Lecture Notes in Computer Science pp. 758-771.

Regan, et al., "An Interactive Graphics Display Architecture," Department of Computer Science, Monash University, Victoria, Australia, Virtual Reality Annual International Symposium, 1993.

Zhou, "Composition on Android with Snapdragon," Uplinq 2011 Qualcomm Conference, 2011.

Intersil Data Sheet, TFT isplay Controller TW8833, TW8833S, Aug. 30, 2011.

* cited by examiner

DISPLAY CONTROLLER

BACKGROUND

The technology described herein relates to display controllers for data processing systems.

As is known in the art, in data processing systems, an image that is to be displayed to a user is processed by the data processing system for display. The image for display is typically processed by a number of processing stages before it is displayed to the user. For example, an image will be processed by a so called "display controller" of a display for display.

Typically, the display controller will read an output image to be displayed from a so called "frame buffer" in memory which stores the image as a data array (e.g. by internal Direct Memory Access (DMA)) and provide the image data appropriately to the display (e.g. via a pixel pipeline) (which display may, e.g., be a screen or printer). The output image is stored in the frame buffer in memory, e.g. by a graphics processor, when it is ready for display and the display controller will then read the frame buffer and provide it to the display for display.

The display controller processes the image from the frame buffer to allow it to be displayed on this display. This processing includes appropriate display timing functionality (e.g. it is configured to send pixel data to the display with appropriate horizontal and vertical blanking periods), to allow the image to be displayed on the display correctly.

As is known in the art, the frame buffer itself is usually stored in so called "main" memory of the system in question, and that is therefore external to the display device and to the display controller. The reading of data from the frame buffer for display can therefore consume a relatively significant amount of power and memory bandwidth.

Many known electronic devices and systems use and display plural windows (or surfaces) displaying information on their display screen, such as video, a graphical user interface, etc.

A common way of providing such windows is to use a compositing window system, in which individual input windows (surfaces) are combined appropriately (i.e. composited) and the result is written out to the frame buffer, which is then read by the display controller for display.

An example of this composition process is shown in FIG. 1. In this process, input surfaces are generated by a video codec 1 and graphics processing unit 2, and stored in main memory 3 (e.g. frame buffer 0, 1 and 2). The stored surfaces are read and passed to a composition engine 4 which combines the input surfaces to generate a composited output frame. In the illustrated example, the composition engine 4 also performs colour space conversion (from YUV to RGB) and scaling operations on the input surface from video codec 1. The composited output frame is stored in main memory 3 (e.g. frame buffer 3). The stored composited output frame is read from the memory 3 by display controller 5, which sends the composited output frame to a local display 6 for display.

A conventional media processing system is shown in FIG. 2. This comprises a central processing unit (CPU) 7, graphics processing unit (GPU) 2, video codec 1, composition engine 4, display controller 5 and a memory controller 8. As shown in FIG. 2, these communicate via an interconnect 9 and have access to off-chip main memory 3. The composition engine 4 generates the composited output frame from one or more input surfaces (e.g. generated by the GPU 2 and/or video codec 1) and the composited output frame is then stored, via the memory controller 8, in a frame buffer in the off-chip memory 3. The display controller 5 then reads the composited output frame from the frame buffer in the off-chip memory 3 via the memory controller 8 and sends it to a display for display.

The Applicants believe that there remains scope for improvements to display controllers.

BRIEF DESCRIPTION OF THE DRAWINGS

Various embodiments of the technology described herein will now be described by way of example only and with reference to the accompanying drawings, in which.

Like reference numerals are used for like components throughout the drawings, where appropriate.

DETAILED DESCRIPTION

Figure 1:
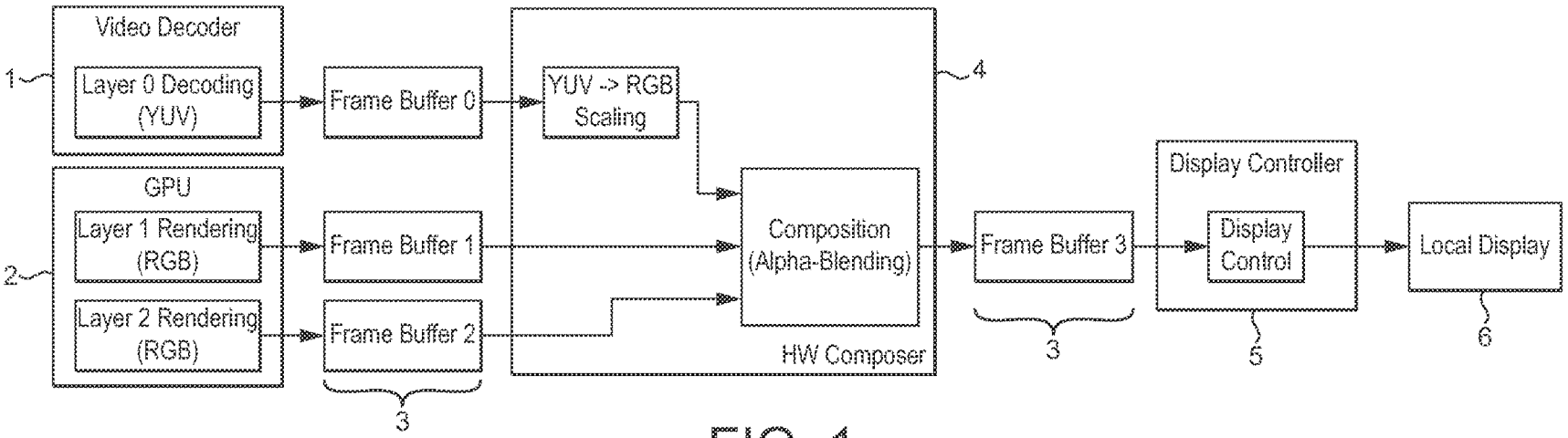
FIG. 1 shows schematically a frame buffer composition process.
Figure 2:
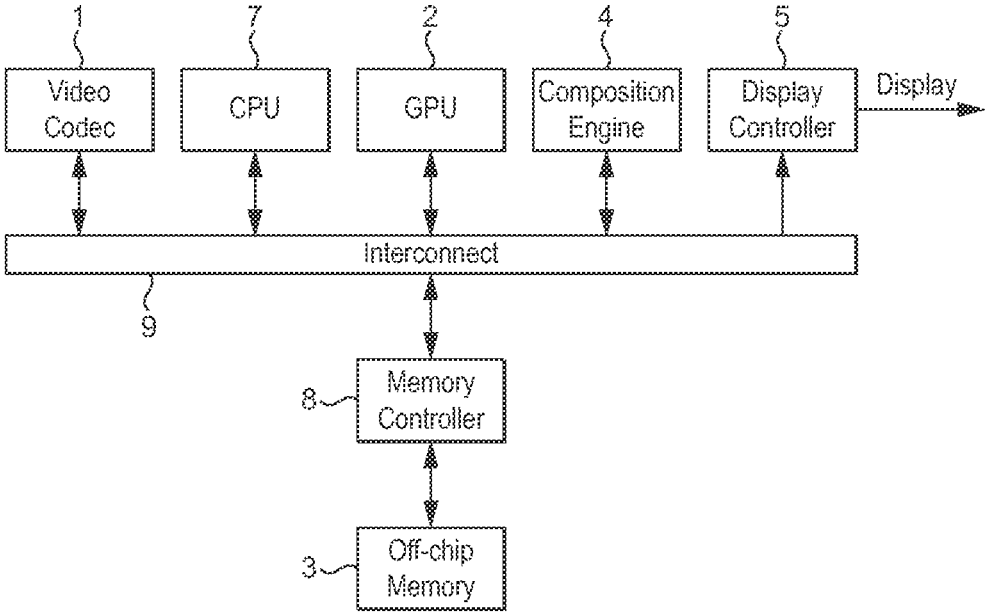
FIG. 2 shows schematically a frame buffer composition system.

A first embodiment of the technology described herein comprises a display controller for a data processing system, the display controller comprising:

- an input stage operable to read at least one input surface;
- a processing stage operable to process one or more read input surfaces to generate an output surface;
- an output stage operable to provide an output surface for display to a display; and
- a write-out stage operable to write an output surface to external memory.

A second embodiment of the technology described herein comprises a method of operating a display controller in a data processing system, the display controller including a write-out stage operable to write an output surface to external memory, the method comprising the display controller:

- reading at least one input surface;
- processing the at least one input surface to generate an output surface;
- writing the generated output surface to external memory; and
- optionally, providing an output surface for display to a display.

As in conventional display controllers, the display controller of the technology described herein includes an input stage and an output stage operable to read in at least one input surface (layer) and to provide an output surface for display to a display. However, in contrast with conventional display controllers, the display controller of the technology described herein further comprises a processing stage operable to process an input surface or surfaces to provide an output surface, and a write-out stage operable to write an output surface to external memory.

The write-out stage means that the display controller of the technology described herein can be operated, e.g., to selectively write out an output surface to external memory (such as a frame buffer), e.g. at the same time as an output surface is displayed on the display. As will be explained more fully below, this can facilitate a greater degree of control and flexibility in the types of operation that can be carried out by the display controller. Moreover, in various cases the display controller of the technology described herein can be used to reduce bandwidth consumption of the overall data processing system, e.g. by reducing the number of reads and/or writes to external memory.

(In data processing systems in lower power and portable devices, the bandwidth cost of writing data to external memory and for the converse operation of reading data from external memory can be a significant issue. Bandwidth consumption can be a big source of heat and of power consumption, and so it is generally desirable to try to reduce bandwidth consumption for external memory reads and writes in data processing systems.)

One exemplary arrangement in which the technology described herein is particularly advantageous is the relatively common situation whereby plural displays are provided and used to display the same output surface. In one common such arrangement, an output surface generated by a data processing system is displayed on the system's local display and is also displayed ("cloned") on a second, external display. It is often the case in such arrangements that the external display will require and use a different resolution and/or aspect ratio to the local display.

Figure 3:
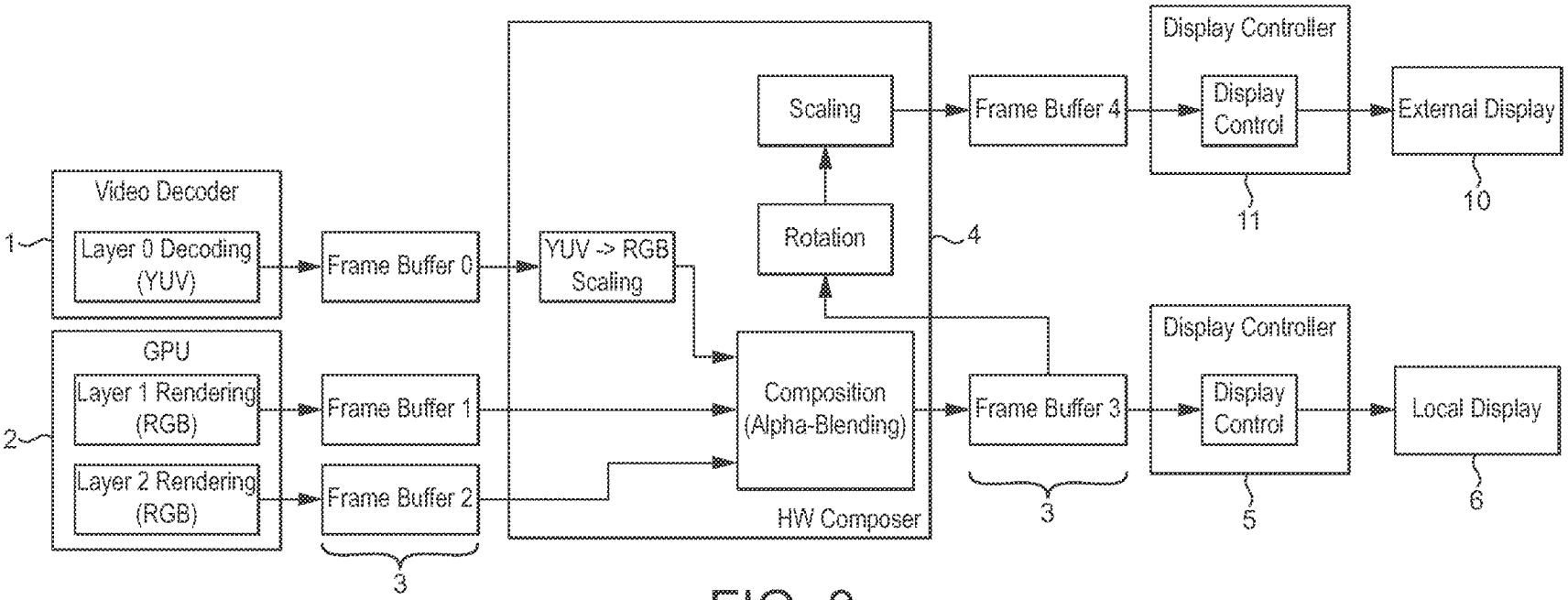
FIG. 3 shows schematically a dual-display frame buffer composition process.

FIG. 3 shows schematically the operation of a conventional dual-display composition system. One or more input surfaces are generated by video codec 1 and/or GPU 2, and stored in main memory 3 (e.g. frame buffer 0, 1 and 2). The stored input surfaces are read by and passed to composition engine 4 which combines (composes) the input surfaces to generate a composited output frame. In the illustrated example, the composition engine 4 also performs colour space conversion and scaling operations on the input surface from video codec 1. The composited output surface is stored in main memory 3 (e.g. in frame buffer 3). The stored composited output surface is then read by the local display controller 5 and displayed on the system's local display 6.

The stored composited output surface is also read back in from main memory 3 by the composition engine 4, before being subjected to appropriate rotation and/or scaling so as to generate an appropriately rotated and/or scaled output surface for the external display 10 (which may require a different resolution and/or aspect ratio for output). The rotated and/or scaled output surface is stored in main memory 3 (e.g. frame buffer 4), before being read by a second display controller 11, and displayed on the external display 10.

Figure 4:
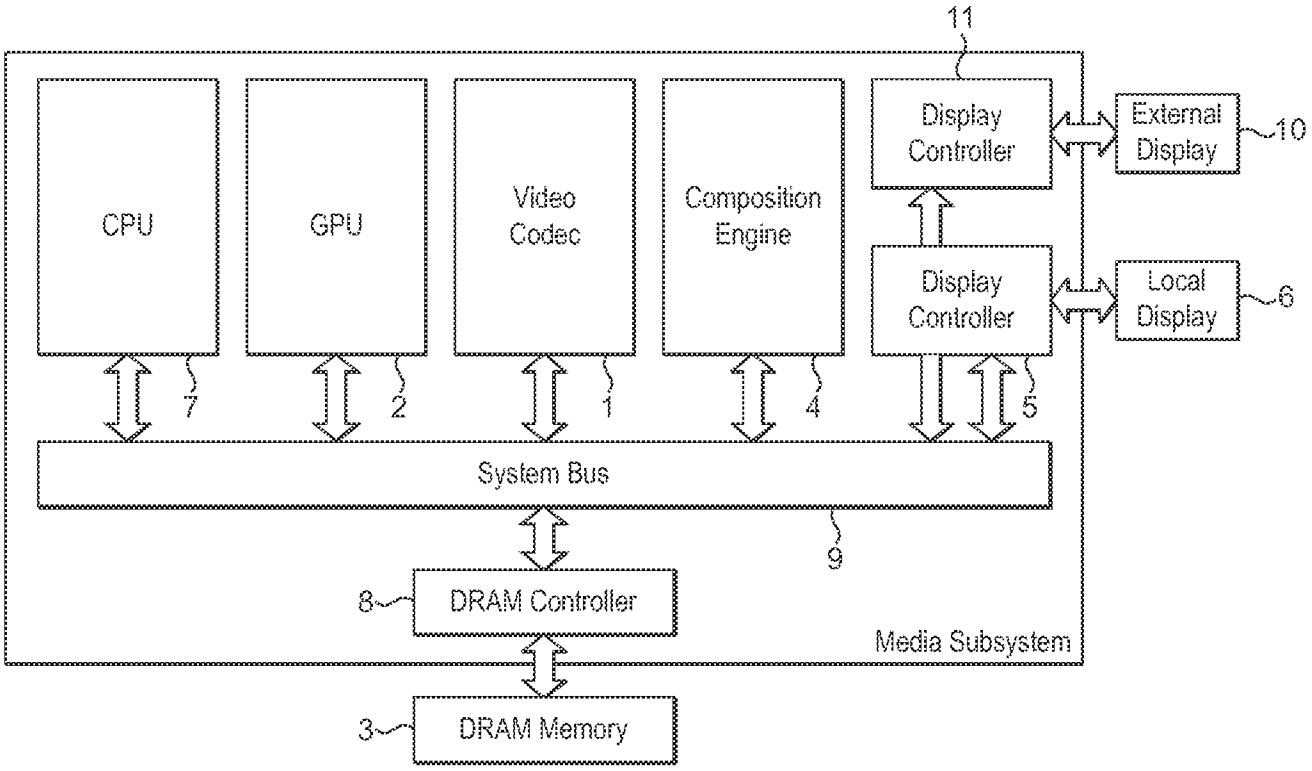
FIG. 4 shows schematically a dual-display frame buffer composition system.

FIG. 4 shows the conventional dual-display composition system, comprising the first 5 and second 11 display controllers for the local 6 and external 10 displays, respectively.

It will be appreciated that in this conventional arrangement, the composition engine 4 must carry out (at least) two writes to the main memory 3 (i.e. one to frame buffer 3 and one to frame buffer 4) and (at least) one read from the main memory 3 (i.e. from frame buffer 3) (after the input surfaces have been read). Equally, each of the display controllers 5, 11 must carry out (at least) one read from the main memory 3.

In contrast, in an embodiment of the technology described herein, in which the display controller of the technology described herein (i.e. with write-back functionality) is used for a dual-display operation (as will be described in more detail below), the display controller may be operated to generate the image for display and output it onto the local display. The display controller may also be operated to write the generated output surface (or a modified version of the generated output surface) to main memory. The output surface stored in main memory may then be read by a second display controller for display on the external display device. In this embodiment, appropriate scaling and/or rotation, etc., of the output frame for the external display may be carried out by the second display controller (i.e. if it is so equipped), or by the display controller of the technology described herein prior to the output frame being written out to main memory.

Thus, in this embodiment of the technology described herein, only one write operation to the main memory and one read operation from the main memory are required for the dual-display operation (i.e. after the at least one input surface has been read). Thus, memory bandwidth is reduced in comparison with the conventional arrangement.

It will therefore be appreciated that in various embodiments of the technology described herein, bandwidth and power consumption of the overall data processing system comprising the display controller of the technology described herein can be reduced.

The input stage may comprise any suitable such stage operable to read the at least one input surface. In an embodiment, the input stage comprises a read controller, such as for example a Direct Memory Access (DMA) read controller.

In an embodiment, the read controller is configured to read the at least one input surface from a memory in which the at least one input surface is stored. The memory may comprise any suitable memory and may be configured in any suitable and desired manner. For example, it may be a memory that is on-chip with the display controller or it may be an external memory. In an embodiment it is an external memory, such as a main memory of the overall data processing system. It may be dedicated memory for this purpose or it may be part of a memory that is used for other data as well. In an embodiment the at least one input surface is stored in (and read from) a frame buffer.

The at least one input surface in the technology described herein may be any suitable and desired such surface. In an embodiment the at least one input surface that is read by the input stage is at least one input surface from which an output surface is to be generated (i.e. by the processing stage). In one embodiment, the at least one input surface is at least one input window (to be displayed), and in an embodiment an image, e.g. frame, for display.

The input surface or surfaces can be generated as desired. For example one or more input surfaces may be generated by being appropriately rendered and stored into a memory (e.g. frame buffer) by a graphics processing system (a graphics processor), as is known in the art. Additionally or alternatively, one or more input surfaces may be generated by being appropriately decoded and stored into a memory (e.g. frame buffer) by a video codec. Additionally or alternatively, one or more input surfaces may be generated by a digital camera image signal processor (ISP), or other image processor. The input surface or surfaces may be, e.g., for a game, a demo, a graphical user interface (GUI), a GUI with video data (e.g. a video frame with graphics "play back" and "pause" icons), etc., as is known in the art.

There may only be one input surface that is read by the input stage (and processed by the processing stage to generate the output surface), but in an embodiment there are plural (two or more) input surfaces that are read by the input stage (and processed by the processing stage to generate the output surface).

The output surface generated by the processing stage may be any suitable and desired such surface. In an embodiment the output surface that is generated by the processing stage is at least one output window (to be displayed), and in an embodiment an image, e.g. frame, for display. As will be discussed further below, in embodiments, the output surface is composited from plural input surfaces (although this need not be the case).

In one embodiment, the processing stage may generate a single output surface. In this embodiment, the single output surface generated by the processing stage may be the output surface for display (i.e. the output surface for display displayed on the display) and/or the output surface written to external memory. Alternatively, the processing stage may generate plural, in an embodiment two, output surfaces. In this embodiment, one of the output surfaces may be the output surface for display (i.e. the output surface for display displayed on the display) and another of the output surfaces may be the output surface written to external memory.

The processing stage may be operable to process the at least one input surface to generate the output surface in any desired manner.

In one embodiment, the processing stage comprises a composition stage operable to compose (two or more) surfaces to generate a composited output surface. The composition stage may be configured to compose the surfaces to generate a composited output surface in any suitable manner as desired. In an embodiment, the composition stage is configured to blend or otherwise combine the surfaces to generate a composited output surface, as is known in the art.

The surfaces that are composed by the composition stage may comprise one or more of the input surfaces read by the input stage and/or one or more modified versions of the input surfaces read by the input stage (e.g. one or more decoded, decompressed, rotated, and/or scaled input surfaces, as will be discussed further below).

The composited output surface may be any suitable and desired such surface. In an embodiment the composited output surface that is generated by the composition stage is an output window (to be displayed), and in an embodiment an image, e.g. frame, for display.

The composited output surface may be a or the "final" output surface generated by the processing stage, or the composited output surface may be subjected to further processing by the processing stage in order to generate a or the output surface (as will be discussed further below).

The input surfaces and the composited output surface may have the same or different sizes, resolutions, etc.

In one embodiment, the processing stage also or instead, and in an embodiment also, comprises a decoding stage operable to decode and/or decompress one or more surfaces, in an embodiment one or more of the input surfaces, e.g. to generate one or more decoded and/or decompressed input surfaces. This is particularly useful in embodiments where one or more of the input surfaces is stored in an encoded and/or compressed form. For example, one or more of the input surfaces may have been subjected to compression, such as for example, ARM Frame Buffer Compression (AFBC) (as described in US-A1-2013/0034309) prior to being stored in memory. Thus, in one embodiment, the decoding stage may comprise an AFBC decoder for decoding one or more of the input surfaces.

The one or more decoded and/or decompressed input surfaces may be a or the "final" output surface generated by the processing stage, but in an embodiment the one or more decoded and/or decompressed input surfaces are subjected to further processing by the processing stage (such as a composition operation) in order to generate a or the output surface.

In one embodiment, the processing stage also or instead, and in an embodiment also, comprises a rotation stage operable to rotate one or more surfaces, in an embodiment one or more of the (optionally decoded and/or decompressed) input surfaces, e.g. to generate one or more rotated input surfaces. This is particularly useful where, for example, it is necessary and/or desired to rotate one or more of the input surfaces (windows), e.g. prior to compositing. The rotation stage may be operable to rotate one or more of the input surfaces by any suitable and desired amount, such as, for example 90°, 180° and/or 270°.

The one or more rotated input surfaces may be a or the "final" output surface generated by the processing stage, but in an embodiment the one or more rotated input surfaces is subjected to further processing by the processing stage in order to generate a or the output surface.

In one embodiment, the processing stage also or instead, and in an embodiment also, comprises a scaling stage or engine operable to scale (e.g. upscale and/or downscale) one or more surfaces, e.g. to generate one or more scaled surfaces. The scaling stage may be operable to scale any one, some, or all of the (optionally modified) input surfaces and/or the (optionally modified) composited output surface.

In an embodiment, the scaling stage (engine) can also perform colour space conversion, e.g., and in an embodiment, RGB to YUV colour space conversion. This may be useful where, for example, the output surface that is written to external memory may be intended for provision to a video engine for encoding for wireless transmission.

In one embodiment, the scaling stage is operable to scale one or more of the (optionally modified, e.g. decoded, decompressed and/or rotated) input surfaces, e.g. so as to generate one or more scaled input surfaces. This is particularly useful where, for example, it is desired to scale one or more of the input surfaces, e.g. prior to composition.

Additionally or alternatively, the scaling stage may be operable to scale the (optionally modified) composited output surface, e.g. to generate a scaled composited output surface. This is particularly useful where, for example, it is desired to scale the composited output surface, e.g. prior to writing it to external memory.

The one or more scaled surfaces may be a or the "final" output surface generated by the processing stage, or the one or more scaled surfaces may be subjected to further processing by the processing stage in order to generate a or the output surface.

The scaling stage may be configured to scale (e.g. upscale or downscale) surfaces by a set degree or factor that cannot be changed. However, in an embodiment, the scaling stage is configured to scale (e.g. upscale and/or downscale) surfaces to any desired degree or factor (or by one or more of a limited number of degrees or factors) (and the degree of scaling is in an embodiment selectable in use).

The display controller and/or scaling stage may be such that (only) particular surfaces are (always) sent to (and received and processed by) the scaling stage. However, in an embodiment, the display controller may be configured so as to be able to selectively send one or more of the surfaces to the scaling stage, such that any one or more of the surfaces may be selectively received by the scaling stage and scaled (up-scaled or down-scaled), e.g. as appropriate and/or desired.

To achieve this (and otherwise), in an embodiment, the processing stage further comprises a data flow controller (multiplexer) operable to receive one or more surfaces and to selectively transmit (direct) one or more of the received surfaces to other stages of the display controller. The data flow controller may be operable to receive one or more of the (optionally modified, e.g. decoded, decompressed, rotated, and/or scaled) input surfaces and/or the (optionally modified) composited output surface (and to selectively transmit one or more of the received surfaces).

In an embodiment, the data flow controller is capable of directing the data flow for (e.g. input) surfaces individually, i.e. such that different surfaces can be directed to different processing stages, independently of each other.

The data flow controller is in an embodiment operable to selectively direct (transmit) one or more of the received surfaces to any part (stage) of the display controller as appropriate. In one embodiment, the data flow controller is configured to selectively transmit surfaces to the composition stage and/or to the scaling engine and/or to the write-out stage.

Thus, for example, in one embodiment, the data-flow controller is operable to receive one or more of the (modified) input surfaces, and to transmit one or more of the received surfaces to the composition stage.

In another embodiment, the data flow controller is operable to receive one or more of the (modified) input surfaces, and to selectively transmit one or more of the received input surfaces to the scaling engine. In this embodiment, the data flow controller may be further operable to receive one or more scaled input surfaces from the scaling engine (e.g. that correspond to the one or more input surfaces that was transmitted to the scaling engine), and to then transmit one or more of the surfaces to the composition stage for composition.

In one embodiment, the data flow controller is operable to receive the (modified) composited output surface, and to transmit it to the write-out stage. In another embodiment, the data flow controller (multiplexer) is operable to receive the (modified) composited output surface, and to transmit it to the scaling engine. In this embodiment, the scaling engine will then in an embodiment scale the received composited output surface, and transmit the scaled composited output surface to the write-out stage, directly or via the data flow controller.

In one embodiment, the processing stage also or instead, and in an embodiment also, comprises one or more "post-processing" stages, e.g. in the form of a post-processing pipeline, operable to selectively perform one or more processing operations on one or more surfaces, e.g. to generate a post-processed surface. The processing stage may be configured such that the one or more post-processing stages receives any of the (modified) input surfaces and/or the (modified) composited output surface, but in an embodiment, the one or more post-processing stages is operable to receive and (selectively) process the composited output surface, e.g. to generate a post-processed composited output surface.

The one or more post-processing stages may comprise, for example, a colour conversion stage operable to carry out colour conversion on a surface, a dithering stage operable to carry out dithering on a surface, and/or a gamma correction stage operable to carry out gamma correction on a surface.

The one or more post-processed surfaces may be subjected to further processing by the processing stage in order to generate a or the output surface, but in an embodiment the one or more post-processed surfaces may be a or the "final" output surface generated by the processing stage.

As will be appreciated from the above, the overall processing stage of the display controller of the present embodiment may, and in an embodiment does, comprise a plurality of processing stages or elements, and in an embodiment comprises one or more of, and in an embodiment all of: a composition stage (engine), a scaling stage (engine), a decoding stage (decoder), a rotation stage (engine), a "post-processing" stage or stages, and a data flow controller. Correspondingly, the processing of the at least one input surface to generate an output surface in an embodiment comprises one or more of and in an embodiment all of: decoding, rotation, composition, scaling and post-processing.

In another embodiment, the processing stage also or instead, and in an embodiment also, comprises a compression stage operable to compress one or more surfaces, e.g. to generate one or more compressed surfaces. The compression stage may be operable to compress any one, some, or all of the (optionally modified) input surface(s) and/or the (optionally modified) (composited) output surface.

Thus, in one embodiment, the compression stage is operable to compress one or more of the (optionally modified, e.g. decoded, decompressed, rotated and/or scaled) input surfaces, e.g. so as to generate one or more compressed output surfaces. Additionally or alternatively, the compression stage may be operable to compress the (optionally modified) composited output surface, e.g. to generate a compressed composited output surface.

The one or more compressed surfaces may be subjected to further processing by the processing stage in order to generate a or the output surface, or in an embodiment the one or more compressed surfaces may be a or the "final" output surface generated by the processing stage.

This is particularly useful where, for example, it is desired to compress the one or more output surfaces, e.g. prior to display. For example, new display interface standards, such as Display Stream Compression (DSC), use compression to compress the data that is sent from the display controller to the display in order to reduce the required bandwidth. Such standards are designed to be mathematically lossy, but "visually lossless", i.e. unnoticeable to the user. (Thus, the compression stage in an embodiment comprises a lossy, in an embodiment substantially visually lossless, compression stage. In an embodiment, the compression stage comprises a Display Stream Compression (DSC) stage.)

There are also benefits where the output surface written to external memory is compressed, as will be discussed further below.

In an embodiment, the data flow controller is configured to selectively transmit surfaces to the compression stage.

The output stage may be any suitable such output stage operable to provide an output surface for display to the display, e.g. to cause the output surface for display to be displayed on the display (to act as a display interface). The output stage in an embodiment comprises appropriate timing control functionality (e.g. it is configured to send pixel data to the display with appropriate horizontal and vertical blanking periods), for the display, as is known in the art.

The output stage is in an embodiment operable to receive the output surface for display before providing it to the display, in an embodiment directly from within the display controller, and in an embodiment directly from the processing stage, i.e. without the output surface for display being output from the display controller or being stored in external memory.

The output surface for display should be and in an embodiment is an output surface generated by the processing stage. In an embodiment, the output surface for display is the (optionally compressed) composited output surface (generated by the composition stage) or the (optionally compressed) post-processed composited output surface (generated by the one or more post-processing stages). In another embodiment, the output surface for display is a compressed (optionally modified) input surface.

The display that the display controller of the technology described herein is used with may be any suitable and desired display, such as for example, a screen or a printer.

The write-out stage may be any suitable such stage that can write an output surface to external memory. In one embodiment, the write-out stage comprises a write controller, such as a Direct Memory Access (DMA) write controller.

The write controller is in an embodiment configured to receive the output surface before writing it to external memory, in an embodiment directly from within the display controller, and in an embodiment directly from the processing stage, i.e. without the output surface being output from the display controller or being stored in external memory.

The output surface written to the external memory should be and in an embodiment is an output surface generated by the processing stage. In an embodiment, the output surface written to external memory is the (optionally compressed) composited output surface (generated by the composition stage) or the (optionally compressed) scaled composited output surface (generated by the scaling stage). In another embodiment, the output surface written to external memory is a compressed (optionally modified) input surface.

The external memory should be and is in an embodiment one or more memories external to the display controller, to which the write-out stage can write data, such as a frame buffer. The external memory is in an embodiment provided as or on a separate chip (monolithic integrated circuit) to the display controller. The external memory in an embodiment comprises a main memory (e.g. that is shared with the central processing unit (CPU)), e.g. a frame buffer, of the overall data processing system.

The various stages of the display controller of the technology described herein may be implemented as desired, e.g. in the form of one or more fixed-function units (hardware) (i.e. that is dedicated to one or more functions that cannot be changed), or as one or more programmable processing stages, e.g. by means of programmable circuitry that can be programmed to perform the desired operation. There may be both fixed function and programmable stages.

One or more of the various stages of the technology described herein may be provided as separate circuit elements to one another. Additionally or alternatively, some or all of the stages may be at least partially formed of shared circuitry.

One or more of the various stages of the technology described herein may be operable to always carry out its function on any and all received surfaces. Additionally or alternatively, one of more of the stages may be operable to selectively carry out its function on the received surfaces, i.e. when desired and/or appropriate.

In an embodiment, the display controller of the technology described herein forms part of a data processing system. Thus, another embodiment of the technology described herein comprises a data processing system comprising the display controller described above.

The data processing system may and in an embodiment does also comprise one or more of, and in an embodiment all of: a central processing unit, a graphics processing unit, a video processor (codec), a system bus, a memory controller, and additional elements as known to those skilled in the art.

The display controller and/or data processing system may be, and in an embodiment is, configured to communicate with one or more of (and the technology described herein also extends to an arrangement comprising one or more of): an external memory (e.g. via the memory controller), one or more local displays, and/or one or more external displays.

Thus, a further embodiment of the technology described herein comprises a data processing system comprising:

- a main memory;
- a display;
- one or more processing units operable to generate input surfaces for display and to store the input surfaces in the main memory; and
- a display controller, the display controller comprising:
  - an input stage operable to read at least one input surface from the main memory;
  - a processing stage operable to process one or more read input surfaces to generate an output surface;
  - an output stage operable to provide the output surface to the display for display; and
  - a write-out stage operable to write an output surface to the main memory.

As will be appreciated by those skilled in the art, these embodiments of the technology described herein can and in an embodiment do include one or more, and in an embodiment all, of the optional features of the technology described herein described herein.

The display controller of the technology described herein may be operated in any appropriate and desired manner.

The operation of the display controller may be fixed and unchangeable, but in an embodiment the display controller is operable in plural modes of operation, i.e. the display controller is in an embodiment controllable and/or programmable to operate in plural modes of operation as appropriate and/or desired.

In an embodiment, each of the at least one input surfaces can be individually, in an embodiment selectively, subjected to decoding and/or decompression and/or rotation and/or scaling, in an embodiment before being composed and/or compressed. In an embodiment, a or the input surface and/or the composited output surface can be selectively subjected to post-processing and/or scaling and/or compression, in an embodiment before being provided to the display and/or before being written to external memory.

In an embodiment, all of the processing carried out by the display controller is performed after reading the at least one input surface from memory only once, i.e. the display controller is in an embodiment configured so as to pass the various input and/or intermediate surfaces between each of its stages without outputting the surfaces from the display controller or storing them in external memory. This then means that, for various modes of operation of the display controller, only a single read (of each input surface) from main memory is required.

In one embodiment, the display controller may be operated to display an output surface on a single (e.g. local) display. In this embodiment, the at least one input surfaces that are read by the input stage are in an embodiment selectively subjected to decoding and/or decompression and/or rotation and/or scaling and/or composition and/or post-processing and/or compression, as described above, before being provided to the display for display. In this embodiment, the write-out stage need not write out an output surface to external memory.

In another embodiment, the display controller may be used to provide output surfaces to plural displays, such as on a local display and one or more external displays. In this embodiment, the display controller may be operated to generate and provide an output for display to one (e.g. the local) display in the manner discussed above for the single display operation. The display controller may be furthermore operated to write out an output surface to external memory, in the manner discussed above.

Thus in an embodiment, the method of the technology described herein comprises the display controller processing at least one input surface to generate an output surface, providing the output surface to a local display for a display, and writing the generated output surface or a modified version of the generated output surface to external memory. In one such embodiment, the generated output surface that is displayed is downscaled and/or compressed before being written out to external memory.

In one embodiment, the display controller may then be operated to read the stored output surface from external memory back in, and to provide the output surface for display to a second (e.g. external) display. The display controller may comprise a second input stage and/or a second output stage configured to perform these operations, or the (same) input stage and/or output stage may be used to perform these operations. Alternatively, a second display controller, e.g., and in an embodiment, configured in the manner of the technology described herein, may be operated to read the stored output surface from external memory, and to provide the output surface for display to a second (e.g. external) display.

Thus, in an embodiment, the data processing system comprises a first display controller in accordance with the technology described herein, and a second display controller (that may, e.g., and in an embodiment, be in accordance with the technology described herein, but need not be), with the, e.g., first, display controller having an interface to a first, e.g. and in an embodiment local, display, and the, e.g., second, display controller having an interface to a second, e.g., and in an embodiment external, display. The first display controller in accordance with the technology described herein in an embodiment then generates an output surface or surfaces for display and writes those output surfaces to external memory, from which they may then be and in an embodiment are read by the second display controller for display on the second display. The first and second display controllers may be distinct display controllers, or they may be respective display controller "cores" of an overall display controller.

This will then allow the first display controller to compose, e.g., a more sophisticated output surface for display on a local display, but to also then provide that output surface for display on a second display, using less memory bandwidth.

In these embodiments, the display controller or the second display controller may optionally be operated to process the stored output surface to generate the output surface for display on the second (e.g. external) display. The stored output surface may be processed in any manner desired, as discussed above. In one embodiment, the stored output surface is subjected to (at least) rotation and/or scaling by the display controller or the second display controller. In an embodiment, the rotation and/or scaling operations are the appropriate operations required to convert the stored output surface into an appropriate output surface (e.g. having the appropriate resolution and/or aspect ratio, etc.) for display on the second (e.g. external) display.

Alternatively, the (first) display controller (configured in accordance with the technology described herein) may be operated to output an output surface to external memory that is an appropriate output surface (e.g. having the appropriate resolution and/or aspect ratio, compression, etc.) for display on the second (e.g. external) display. Thus, in this embodiment, the output surface that is output to external memory is in an embodiment an output surface that has been subjected to (at least) rotation and/or scaling and/or compression by the (first) display controller (configured in accordance with the technology described herein) so as to in an embodiment generate an appropriate output surface (e.g. having the appropriate resolution and/or aspect ratio, compression, etc.) for display on the second (e.g. external) display.

This then means that the second display controller need not process the stored output surface before providing it to the second (external) display (or can perform a reduced or minimum amount of processing). In an embodiment, the second display controller operates only to scale (and in an embodiment to upscale) the output surface generated and stored by the first display controller.

Moreover, this then means that the second display controller need not be a display controller configured in accordance with the technology described herein, and can instead be a "standard" display controller. In this embodiment, the second, e.g. "standard", display controller should be, and in an embodiment is, operated to read the stored output surface from external memory, and to provide the output surface for display to the second (e.g. external) display.

Thus, an embodiment of the technology described herein comprises a data processing system that includes a first display controller that has an interface to a first, e.g., and in an embodiment local, display of the data processing system, and that is a display controller in accordance with the technology described herein, and a second display controller that has an interface to a second, e.g. and in an embodiment external, display, which second display controller need not be (but in an embodiment is) in accordance with the technology described herein, and the system is operable such that (and in an embodiment operates such that) the first display controller generates an (optionally compressed) output surface from one or more input surfaces and provides it to the first display, and also writes the (optionally compressed) output surface provided to the first display, or, in an embodiment, a modified (and in an embodiment downscaled) version of the (optionally compressed) output surface provided to the first display, to external memory, with the second display controller then reading that output surface from the external memory and providing it to the second display. At least in the case where the output surface provided to the first display is downscaled before writing it to the external memory by the first display controller, the second display controller in an embodiment upscales the output surface from the external memory before providing it to the second display.

This will then provide a mechanism for displaying the same output surface on different displays, for example, in full HD, but with significant savings in memory bandwidth as compared to conventional arrangements (e.g. because the output surface that is displayed on the second display is written out and stored in a downscaled form, before being upscaled by the second display controller, and because the number of read and write accesses to main memory is reduced when compared with conventional methods).

It is believed that such arrangements may be new and advantageous in their own right.

Thus, a further embodiment of the technology described herein comprises a data processing system comprising:

a main memory;

a display;

one or more processing units operable to generate input surfaces for display and to store the input surfaces in the main memory; and a first display controller, the first display controller comprising:

an input stage operable to read at least one input surface from the main memory;

a processing stage operable to process one or more read input surfaces to generate an output surface;

an output stage operable to provide the output surface to the display for display; and a write-out stage operable to write an output surface to the main memory;

the data processing system further comprising:

a second display controller comprising:

an input stage operable to read the stored output surface from the main memory; and an output stage operable to provide the output surface to a second display for display.

Another embodiment of the technology described herein comprises a method of operating a display controller in a data processing system, the data processing system comprising:

a main memory;

a display;

one or more processing units operable to generate input surfaces for display and to store the input surfaces in the main memory; and a first display controller, the first display controller comprising:

an input stage operable to read at least one input surface from the main memory;

a processing stage operable to process one or more read input surfaces to generate an output surface;

an output stage operable to provide the output surface to the display for display; and a write-out stage operable to write an output surface to the main memory; and the data processing system further comprising:

a second display controller comprising:

an input stage operable to read the stored output surface from the main memory; and an output stage operable to provide the output surface to a second display for display;

the method comprising:

the first display controller:

reading at least one input surface from the main memory;

processing the at least one input surface to generate an output surface;

providing the generated output surface to the display; and writing the generated output surface or a modified version of the generated output surface to the main memory; and the second display controller reading the output surface from the main memory and providing it to the second display for display.

As will be appreciated by those skilled in the art, these embodiments of the technology described herein can and in an embodiment do include one or more, and in an embodiment all, of the optional features of the technology described herein described herein. Thus, for example, the first display controller in an embodiment downscales the output surface that has been provided to the first display before writing it to the main (external) memory, and the second display controller in an embodiment upscales the output surface once it has read it from the main (external) memory before providing it to the second display for display.

In those embodiments that use compression, the display controller may be operated to generate one or more compressed output surfaces for display, and/or one or more compressed output surfaces for writing to external memory. Accordingly, in this embodiment, the output surface generated by the processing stage is in an embodiment a compressed output surface, the output surface provided to the display is in an embodiment a compressed output surface, and the output surface written to external memory is in an embodiment a compressed output surface.

The Applicants have recognised that this is particularly useful, for example, in the plural display (cloning) arrangement (as discussed above), particularly where the second display controller also uses compression (e.g. comprises a Display Stream Compression (DSC) stage). This is because, for example, by compressing an output surface before writing it to external memory, memory bandwidth can be saved, both for the write operation and for any subsequent read operation (e.g. by the second, external display controller, as discussed above).

Furthermore, where the second display controller also uses compression (e.g. DSC), by having the first display controller output an already compressed version of the output surface, if the second display controller does not need to modify the output surface the second display controller will not need to (and in an embodiment does not) perform a compression operation itself. In the case where the display controller modifies only a portion or portions of the output surface, the second display controller will not need to (and in an embodiment does not) perform a compression operation for the unmodified portion(s) of the output surface. Accordingly, the power and bandwidth costs of the system can be further reduced.

In one embodiment, the compressed output surface provided to the display and the compressed output surface written to external memory may comprise the same compressed output surface. In this embodiment, the display controller is in an embodiment operated to generate the compressed output surface, and to provide the compressed output surface to the display and to write the compressed output surface to external memory (e.g. via the data flow controller, as discussed above).

In another embodiment, the compressed output surface provided to the display and the compressed output surface written to external memory may comprise different compressed output surfaces. For example, the compressed output surface written to external memory may comprise a modified (e.g. rotated and/or scaled) version of the compressed output surface provided to the display.

In this embodiment, the compression stage may be operated to generate a compressed output surface (for display on the local display), which may then be modified (e.g. rotated and/or scaled) by the processing stage, before being output to external memory. However, in an embodiment, the modification (e.g. rotation and/or scaling) operation(s) may be carried out before the compression operation. This is done in many cases since the modification (e.g. rotation and/or scaling) operation(s) will typically be compatible with uncompressed data, but may not be compatible with compressed data (e.g. when using DSC).

In this latter embodiment, the display controller is in an embodiment operated to generate a first compressed output surface and a second compressed (optionally modified) output surface, and to provide the first compressed output surface to the display, and to write the second compressed output surface to external memory. Thus, in this embodiment, the compression stage may be operable to perform (at least) two compression operations (per output surface). Where the compression stage is used to compress each surface output to the display (i.e. as will typically be the case in DSC arrangements), the compression stage may generate the second compressed (modified) output surface when not (otherwise) in use, e.g. during horizontal and/or vertical blanking periods. Alternatively, a second compression stage may be provided to generate the second compressed (modified) output surface.

In some embodiments, the display controller and/or data processing system comprises, and/or is in communication with, one or more memories and/or memory devices that store the data described herein, and/or store software for performing the processes described herein. The display controller and/or data processing system may also be in communication with and/or comprise a host microprocessor, and/or with and/or comprise a display for displaying images based on the data generated by the display controller.

The technology described herein can be implemented in any suitable system, such as a suitably configured microprocessor based system. In an embodiment, the technology described herein is implemented in a computer and/or micro-processor based system.

The various functions of the technology described herein can be carried out in any desired and suitable manner. For example, the functions of the technology described herein can be implemented in hardware or software, as desired. Thus, for example, unless otherwise indicated, the various functional elements and "means" of the technology described herein may comprise a suitable processor or processors, controller or controllers, functional units, circuitry, processing logic, microprocessor arrangements, etc., that are operable to perform the various functions, etc., such as appropriately dedicated hardware elements and/or programmable hardware elements that can be programmed to operate in the desired manner.

It should also be noted here that, as will be appreciated by those skilled in the art, the various functions, etc., of the technology described herein may be duplicated and/or carried out in parallel on a given processor. Equally, the various processing stages may share processing circuitry, etc., if desired.

Furthermore, any one or more or all of the processing stages of the technology described herein may be embodied as processing stage circuitry, e.g., in the form of one or more fixed-function units (hardware) (processing circuitry), and/or in the form of programmable processing circuitry that can be programmed to perform the desired operation. Equally, any one or more of the processing stages and processing stage circuitry of the technology described herein may be provided as a separate circuit element to any one or more of the other processing stages or processing stage circuitry, and/or any one or more or all of the processing stages and processing stage circuitry may be at least partially formed of shared processing circuitry.

Subject to any hardware necessary to carry out the specific functions discussed above, the graphics processing pipeline can otherwise include any one or more or all of the usual functional units, etc., that graphics processing pipelines include.

It will also be appreciated by those skilled in the art that all of the described embodiments of the technology described herein can, and in an embodiment do, include, as appropriate, any one or more or all of the features described herein.

The methods in accordance with the technology described herein may be implemented at least partially using software e.g. computer programs. It will thus be seen that when viewed from further embodiments the technology described herein provides computer software specifically adapted to carry out the methods herein described when installed on a data processor, a computer program element comprising computer software code portions for performing the methods herein described when the program element is run on a data processor, and a computer program comprising code adapted to perform all the steps of a method or of the methods herein described when the program is run on a data processing system. The data processor may be a microprocessor system, a programmable FPGA (field programmable gate array), etc.

The technology described herein also extends to a computer software carrier comprising such software which when used to operate a graphics processor, renderer or microprocessor system comprising a data processor causes in conjunction with said data processor said processor, renderer or system to carry out the steps of the methods of the technology described herein. Such a computer software carrier could be a physical storage medium such as a ROM chip, CD ROM, RAM, flash memory, or disk, or could be a signal such as an electronic signal over wires, an optical signal or a radio signal such as to a satellite or the like.

It will further be appreciated that not all steps of the methods of the technology described herein need be carried out by computer software and thus from a further broad embodiment the technology described herein provides computer software and such software installed on a computer software carrier for carrying out at least one of the steps of the methods set out herein.

The technology described herein may accordingly suitably be embodied as a computer program product for use with a computer system. Such an implementation may comprise a series of computer readable instructions either fixed on a tangible, non-transitory medium, such as a computer readable medium, for example, diskette, CD-ROM, ROM, RAM, flash memory, or hard disk. It could also comprise a series of computer readable instructions transmittable to a computer system, via a modem or other interface device, over either a tangible medium, including but not limited to optical or analogue communications lines, or intangibly using wireless techniques, including but not limited to microwave, infrared or other transmission techniques. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical, or transmitted using any communications technology, present or future, including but not limited to optical, infrared, or microwave. It is contemplated that such a computer program product may be distributed as a removable medium with accompanying printed or electronic documentation, for example, shrink-wrapped software, preloaded with a computer system, for example, on a system ROM or fixed disk, or distributed from a server or electronic bulletin board over a network, for example, the Internet or World Wide Web.

An embodiment of the technology described herein will now be described with reference to FIGS. 5 to 9.

Figure 5:
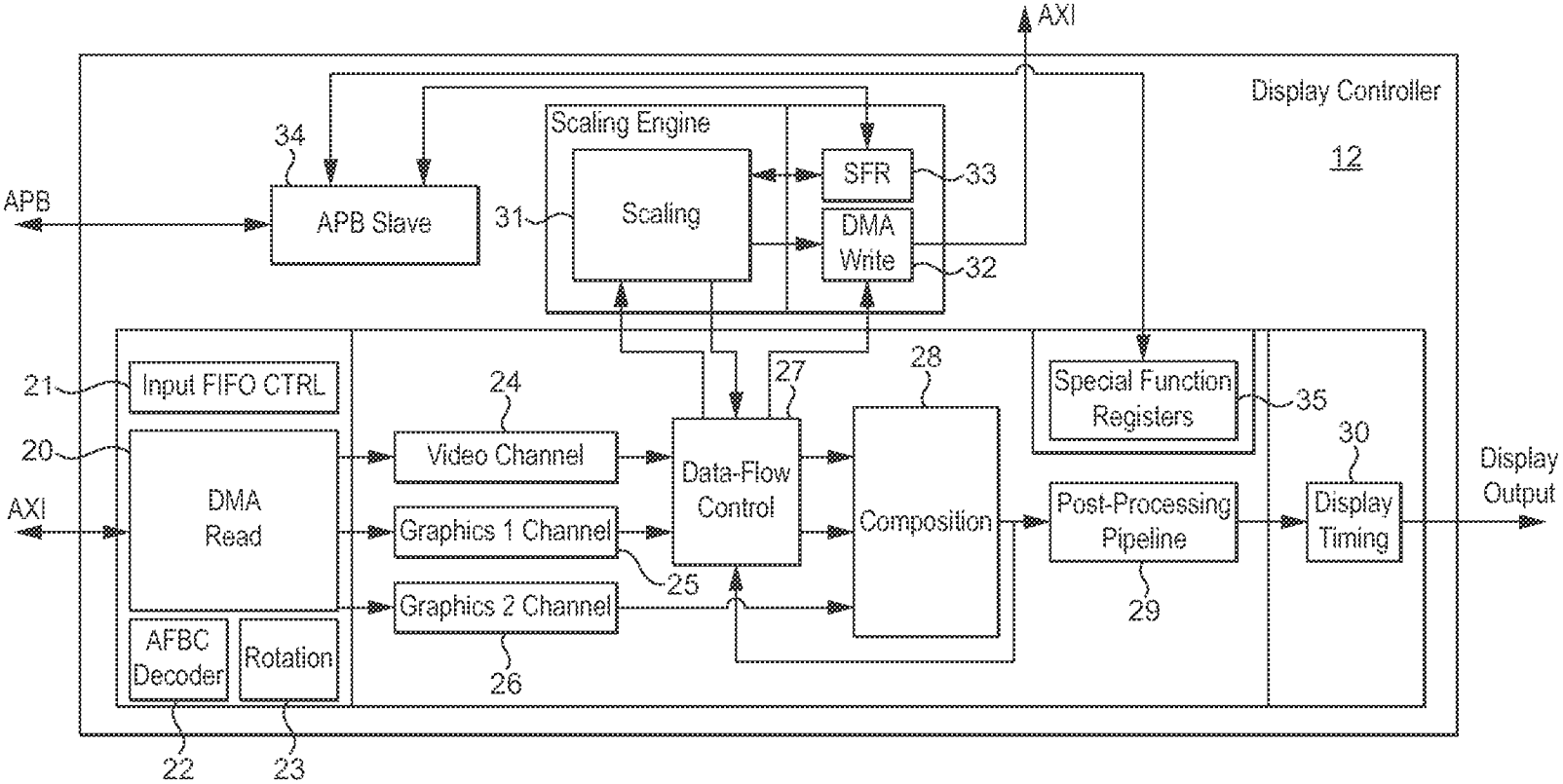
FIG. 5 shows schematically a display controller in accordance with an embodiment of the technology described herein.

FIG. 5 shows schematically a display controller 12 in accordance with an embodiment of the technology described herein. In FIG. 5, the shaded rectangles represent functional units of the display controller, while the arrowed lines represent connections between the various functional units.

In the present embodiment, the display controller 12 comprises a read controller in the form of a Direct Memory Access (DMA) read controller 20. The read controller 20 is configured to read one or more input surfaces from a main memory 3 (not shown in FIG. 5) via an Advance eXtensible Interface (AXI). The one or more input surfaces will typically be in the form of RGB data. Input FIFO control 21 controls the operation of the read controller 20, as is known in the art.

Co-located with the read controller 20 is a frame buffer compression decoder 22 which can be used to (selectively) decode the received input surfaces as necessary, before onward transmission of the one or more input surfaces by the read controller 20. Similarly, rotation unit 23 can be used to selectively rotate one or more of the input surfaces as necessary before onward transmission of the one or more input surfaces.

In the illustrated embodiment, the read controller 20 is configured to (read) up to three different input surfaces (layers) which are to be used to generate a composited output frame. In this embodiment, the three input layers comprise one video layer, e.g. generated by a video processor (codec), and two graphics layers, e.g. two graphics windows generated by a graphics processing unit (GPU). Hence, FIG. 5 shows the read controller 20 onwardly transmitting three input surfaces (display layers) via three channels, namely video channel 24, a first graphics channel 25, and a second graphics channel 26. Any or all of the transmitted input surfaces may have been subjected to decoding by decoder 22 and/or rotation by rotation unit 23, as discussed above.

Although the embodiment of FIG. 5 illustrates the use of three input surfaces, it will be appreciated that any number of input surfaces (layers) may be used in the technology described herein, depending on the application in question (and also depending on any silicon area constraints, etc.). Equally, any number of channels may be provided and used, as desired.

The display controller 12 of the present embodiment further comprises a multiplexer/data-flow control 27. In the illustrated embodiment, the display controller is configured such that multiplexer 27 receives inputs from, inter alia, video channel 24 and the first graphics channel 25. It will be appreciated, however, that in other embodiments, the display controller 12 may be configured such that multiplexer 27 receives inputs from any one or more (or all) of the input surface channels. The multiplexer 27 operates to selectively transmit any one or more (or all) of the received inputs (i.e. surfaces) to any one or more of the multiplexer's 27 outputs.

The display controller 12 of the present embodiment further comprises a composition unit 28. In the illustrated embodiment, the display controller is configured such that composition unit 28 receives inputs from the multiplexer 27, as well as directly from the second graphics channel 26. It will be appreciated, however, that in other embodiments, the display controller 12 may be configured such that the composition unit 28 receives inputs directly from any one or more of the channels, or alternatively exclusively from the multiplexer 27.

The composition unit 28 operates, as is known in the art, to compose the received input surfaces to generate a composited output frame, i.e. by appropriate blending operations, etc. In the illustrated embodiment, the composited output frame is onwardly transmitted by the composition unit 28 to multiplexer 27, and also to post-processing pipeline 29.

The post-processing pipeline 29 is configured to selectively carry out any desired processing operation(s) on the composited output surface (frame). The post-processing pipeline 29 may, for example, comprise a colour conversion stage operable to apply a colour conversion to the composited output frame, a dithering stage operable to apply dithering to the composited output frame, and/or a gamma correction stage operable to carry out gamma correction on the composited output frame.

In the present embodiment, the post-processing pipeline 29 is configured to transmit the (processed) composited output frame to an output stage comprising a display timing unit 30 for appropriate display on a (local) display (not shown).

The display timing unit 30 is configured to send pixel data to the display with appropriate horizontal and vertical blanking periods, as is known in the art. Horizontal and vertical synchronization pulses (HSYNC, VSYNC) are generated together with a DATAEN signal which is asserted in non-blanking periods. In blanking periods DATAEN is de-asserted and no data is sent to the display (as is known in the art, there are 4 blanking periods: horizontal front porch—before the HSYNC pulse, horizontal back porch—after the HSYNC pulse, vertical front porch—before the VSYNC pulse, and vertical back porch—after the VSYNC pulse).

The display controller 12 of the present embodiment further comprises a scaling engine 31. The display controller 12 is configured such that the scaling engine 31 receives inputs from the multiplexer 27. The multiplexer 27 may be operated, for example, to transmit any one or more of the input surfaces (i.e. from video channel 24, graphics channel 25, and/or graphics channel 26) and/or the composited output frame (i.e. from composition unit 28) to the scaling engine 31.

The scaling engine 31 operates to (selectively) scale (i.e. upscale or downscale) any one or more of the received surfaces (frames) to generate a scaled surface (frame). Thus, the scaling engine 31 may be operated to scale any one or more of the input surfaces (i.e. from video channel 24, graphics channel 25, and/or graphics channel 26) to generate one or more scaled input surfaces and/or the composited out frame to generate a scaled composited output frame. In the present embodiment, the degree to which a surface is scaled can be selected as desired, i.e. depending on the particular application, etc.

The scaling engine 31 is configured to selectively transmit the scaled surface to the multiplexer 27 and/or to write controller 32. Thus, for example, the display controller 12 may be operated to scale one or more of the input surfaces (i.e. from video channel 24, graphics channel 25, and/or graphics channel 26) using the scaling engine 31 prior to the one or more input surfaces being composited by composition unit 28. Equally, the display controller 12 may be operated to scale the composited output frame using the scaling engine 31, e.g. prior to the composited output frame being transmitted to write controller 32 (and being written out therefrom to main memory 3).

In the present embodiment, the write controller 32 takes the form of a DMA write controller. The write controller 32 is configured to write out received surfaces (frames) to external memory 3 (e.g. frame buffer) via AXI. The write controller 32 of the present embodiment is configured to receive surfaces (frames) for output from the scaling engine 31 and from the multiplexer 27. Thus, in embodiments, the write controller 32 may be operated to write out the scaled or non-scaled composited output frame to main memory.

In the present embodiment, co-located with the scaling engine 31 is special function register (SFR) 33 which is configured to communicate with the scaling engine 31. Advanced Peripheral Bus (APB) slave 34 communicates with SFR 33, and SFR 35 and with an APB interface.

Thus, this embodiment of the technology described herein comprises a display controller that integrates a composition unit 28, a decoder 22, and a rotation unit 23, as well as a scaling engine 31 capable of up and down-scaling surfaces. The display controller is capable of sending the scaled surfaces to a local display pipeline and/or writing them back to the frame buffer. Multiple different modes of operation can be performed by the display controller, e.g. by operating multiplexer 27 to control data flows through the controller.

The composition unit 28 is embedded within the display controller, such that surfaces composed by the composition unit 28 may be displayed on the display with only a single read (of each input surface) from the frame buffer being required. Intermediate composition data need not be written to external memory.

Prior to composition, the surfaces can be individually rotated, decoded and/or pre-processed (e.g. linear and non-linear colour conversions). All of this processing may be carried out after a single read of the input frames from external memory.

Prior to composition, any one or more of the surfaces can be up or down-scaled by the scaling engine 31. Depending on the software configuration, the data-flow controller 27 can be operated to send any of the input surfaces (e.g. video or graphics input layers) to the scaling engine 31. The input surfaces may then be processed (scaled) and sent back to the display engine, to be composed and displayed. Again, the scaling operations carried out by the display controller 12 may be done after a single read of the input surfaces from external memory. No intermediate data need be written to external memory.

Thus, the display controller 12 of the present embodiment supports scaling of rotated, decoded surfaces and 3D video surfaces, all in single pass.

After composition, the output surface (e.g. RGB pixel stream) may be sent to the display 6 through the post-processing pipeline 29, which can optionally apply colour conversions, dithering, and/or gamma correction. The same composition result can also be sent to the scaling engine 31 to be scaled and written to the memory 3, or the composition result can be written to memory 3 without scaling.

Although not shown in the embodiment of FIG. 5, in other embodiments the display controller 12 may additionally or alternatively comprise a compression stage operable to compress one or more received surfaces, e.g. to generate one or more compressed surfaces, e.g. before the one or more compressed surfaces are output to the display and/or written to memory 3.

Figure 6:
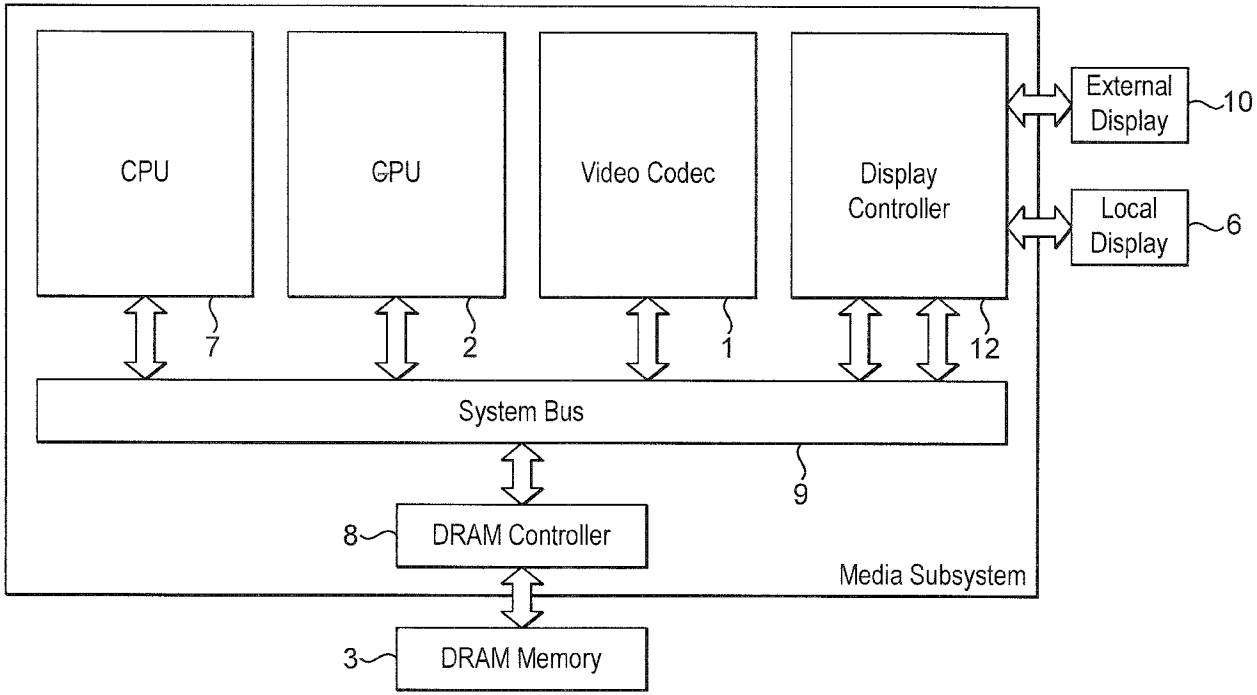
FIG. 6 shows a composition system in accordance with an embodiment of the technology described herein.

FIG. 6 shows a display composition system in accordance with an embodiment of the technology described herein. The system corresponds to the system of FIG. 4, except that the two display controllers 5, 11 are replaced with a display controller 12 in accordance with the embodiment of the technology described herein. The display controller 12 is operable to communicate with (e.g. to cause output frames to be displayed on) local display device 6 and external display device 10.

Figure 7:
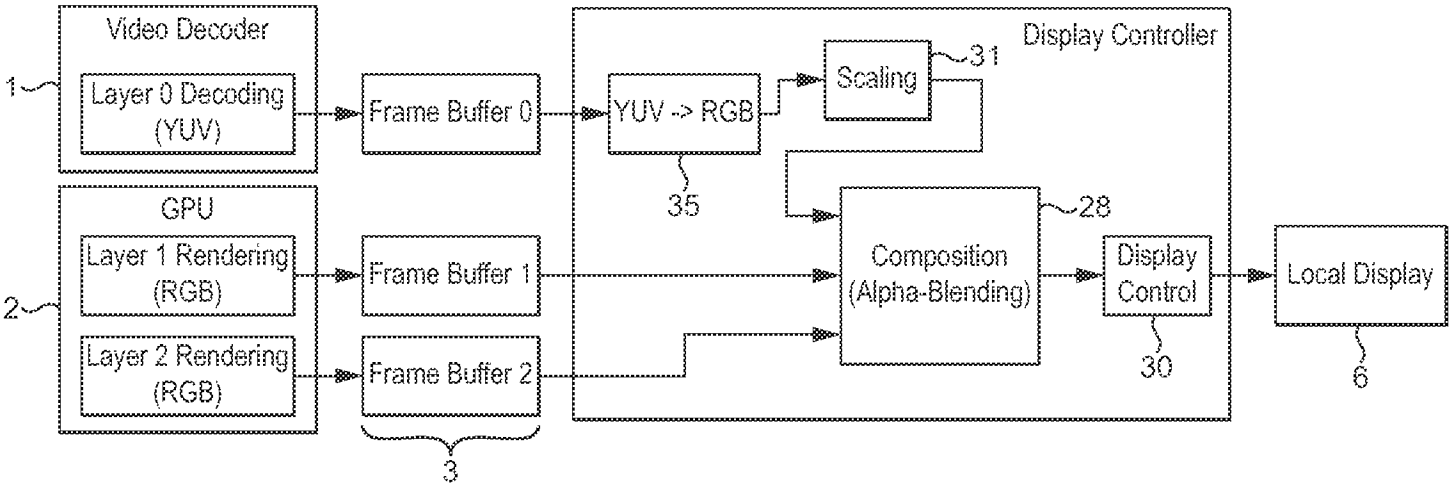
FIG. 7 shows a composition process in accordance with an embodiment of the technology described herein.

FIG. 7 illustrates schematically a method of operating the display controller 12 of the technology described herein in a single display configuration, in accordance with an embodiment. Video codec 1 and GPU 2 generate one or more input surfaces, which are stored in the main memory 3 (e.g. frame buffers 0, 1 and 2). The video input surface is read in by the display controller 12 and is subjected to a colour space conversion operation, and a scaling operation, before being transmitted to the composition unit 28 for composition. The graphics input surfaces are fed directly to the composition unit 28. The composition unit 28 composes the received input surfaces and generates a composited output frame, which is then caused to be displayed on the local display 6 by display control 30.

Figure 8:
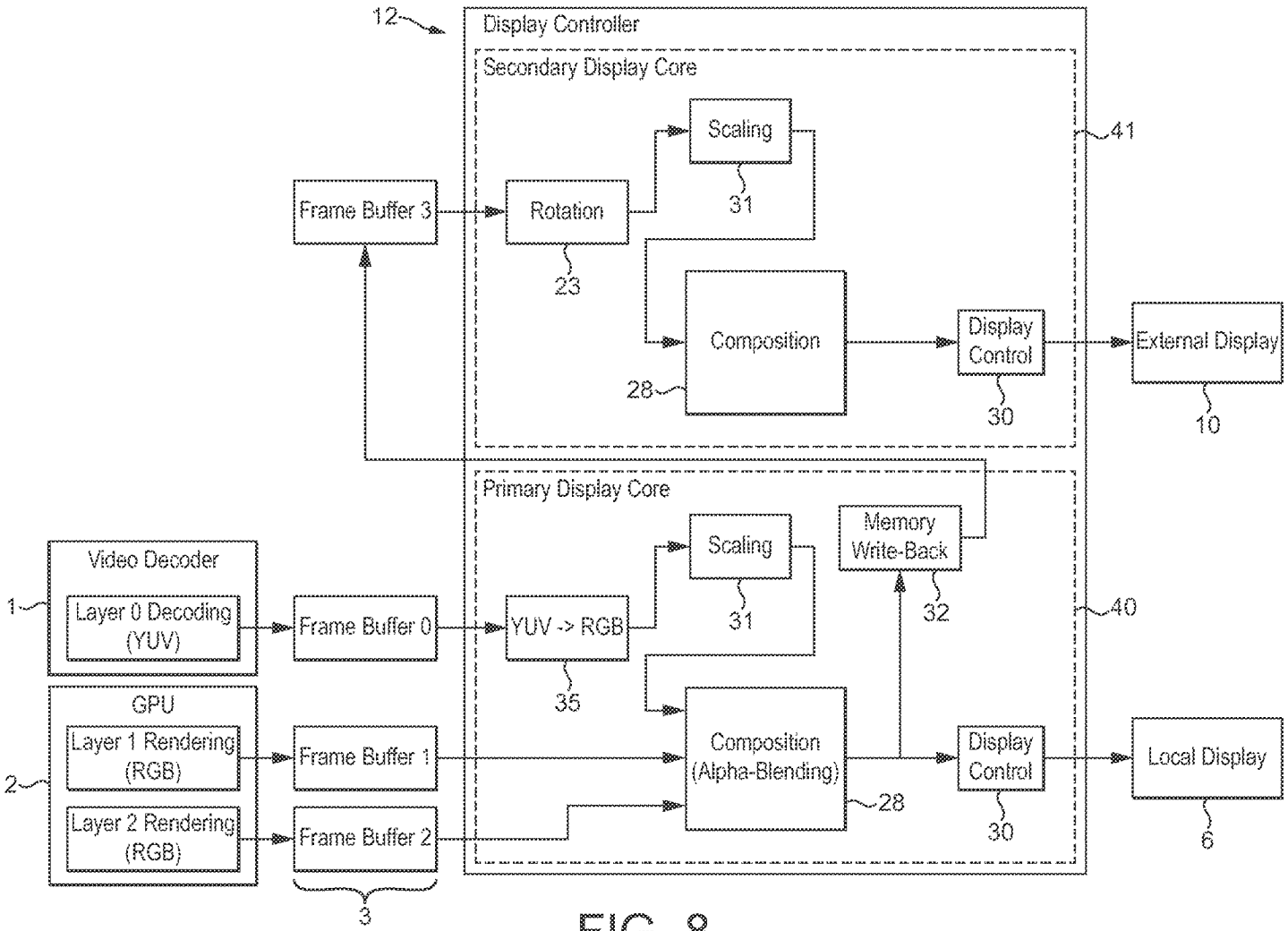
FIG. 8 shows a dual-display composition process in accordance with an embodiment of the technology described herein.

FIG. 8 illustrates schematically an embodiment of a display controller 12 that is in accordance with the technology described herein in a dual display configuration. In this embodiment, the display controller 12 includes two display "cores" 40, 41 which interface, respectively, with a local display 6 and an external display 10.

Video codec 1 and GPU 2 generate one or more input surfaces, which are stored in the main memory 3 (e.g. frame buffers 0, 1 and 2). The video input surface is read in by the primary core 40 of the display controller 12 and subjected to a colour space conversion operation and a scaling operation, before being transmitted to the composition unit 28 for composition. The graphics input surfaces are fed directly to the composition unit 28. The composition unit 28 composes the received input surfaces and generates a composited output frame, which is then caused to be displayed on the local display 6 by display control 30.

The composited output frame is also transmitted to a write controller 32 of the primary display core 40, which writes the composited output frame to main memory 3 (e.g. frame buffer 3).

The secondary display core 41 of the display controller 12 then reads in the composited output frame from the main memory 3, and subjects it to the appropriate rotation, scaling and composition, before causing it to be displayed on the external display 10 using display control 30.

In an alternative embodiment, instead of the display controller 12 having two display "cores" as shown in FIG. 8, the secondary display core 41 may instead be a second, separate display controller that reads in the composited output frame from the main memory 3, subjects it to the appropriate rotation, scaling and composition, and causes it to be displayed on the external display 10.

In these arrangements, the second display controller or the secondary display core may be configured in accordance with the technology described herein. Alternatively, the second display controller or secondary display core 41 may be configured as (may comprise) a "conventional" display controller. In this embodiment, the first display controller 12 (primary display core) may be operated to carry out the appropriate rotation and/or scaling, before the composited output frame is output to the external memory 3. The second display controller (secondary display core) need not then have any functionality other than "standard" display controller functionality.

In either of these embodiments, when compared with conventional methods, the number of read and write accesses to main memory is reduced.

Figure 9A:
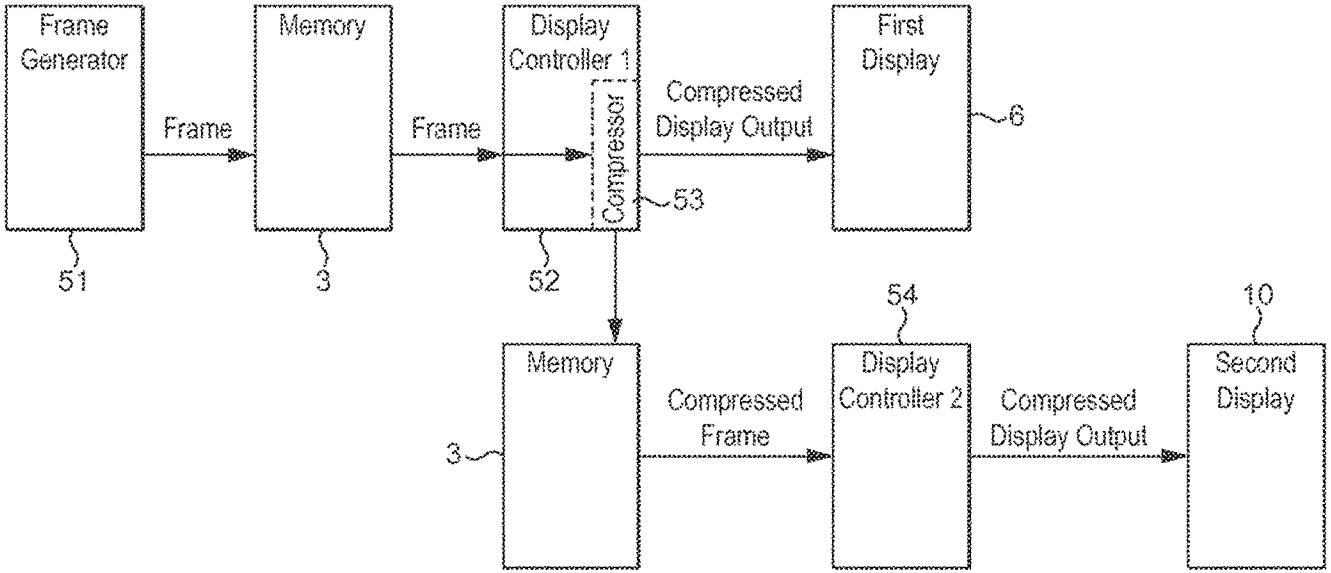
FIGS. 9A and 9B show dual-display processes that use compression in accordance with embodiments of the technology described herein.
Figure 9B:
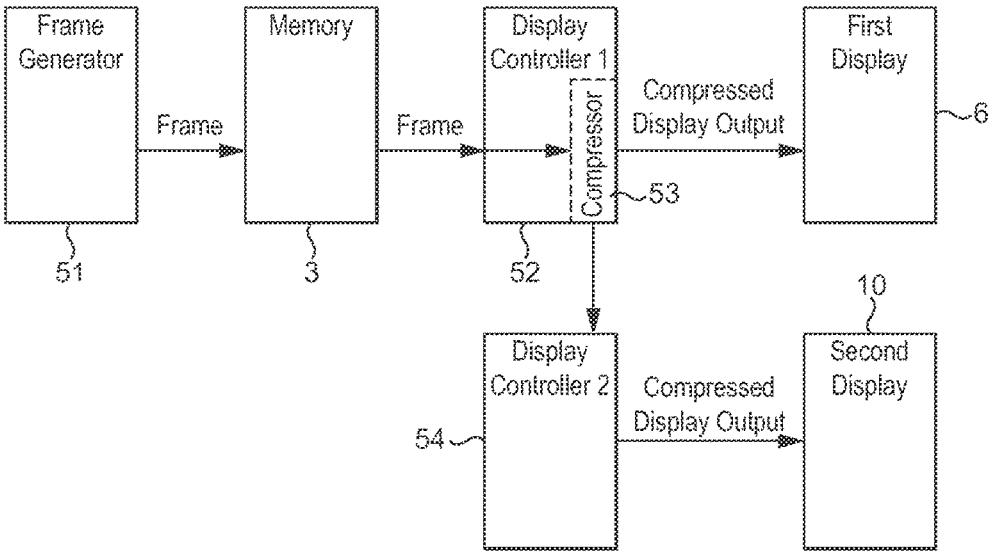

FIGS. 9A and 9B illustrate schematically embodiments of a dual display configuration that is in accordance with the technology described herein.

In both FIGS. 9A and 9B, frame generator 51 (which may comprise, e.g. a Camera Image Signal Processor (ISP), CPU, GPU, Video Engine/Codec, image processor, etc.) generates one or more frames, which are stored in main memory 3. The frame is read in by the display controller 52, is optionally modified and/or composited, etc. (e.g. as described above), and is compressed by compression stage 53. In the present embodiment, the compression stage may comprise a Display Stream Compression (DSC) stage. The compressed output is then sent to the local display 6, and displayed.

The compressed output or a modified version is also sent to second display controller 54 for re-use (i.e. cloning). FIG. 9A shows an embodiment where the data is sent to the second display controller 54 via main memory 3, while FIG. 9B shows an embodiment where the data is sent to the second display controller 54 directly.

In the present embodiment, the second display controller 54 receives or reads in the data from memory 3, optionally modifies all or one or more portions of the received data, before sending it to an external display 10 (e.g. via a wired or wireless connection).

Thus, in these arrangements the (DSC) compressed image can be both displayed and written back by the first display controller 52, to be fetched and displayed by the second display controller 54.

In these arrangements, the data that is sent from the first display controller 52 to the second display controller 54 is compressed. Furthermore, if the second display controller 54 does not modify the data before it is displayed, then the second display controller 54 need not perform its own compression operation to generate an appropriately compressed display output (e.g. where DSC is being used by the second display controller 54). If the second display controller 54 does modify one or more regions (e.g. one or more blocks or tiles) of the data, then the second display controller 54 need not compress those regions that are not modified to generate the compressed display output. Accordingly, the bandwidth and power requirements of the system can be reduced.

In the present embodiment, if the image for the second display controller 54 requires rotation, the rotation is performed in the first display controller 52, and the frame that is to be written back to memory 3 is compressed separately from the frame to be displayed on the local display 6. This is because DSC is not compatible with rotation.

If the image for the second display controller 54 requires (down) scaling, this can be performed by the first display controller 52 (and the frame that is to be written back to memory 3 should then be compressed separately), or by the second display controller 54 (and the frame that is to be written back to memory 3 should then be the same compressed frame that is sent to local display 6), depending on the nature of the scaling.

Where the frame that is to be written back to memory 3 is compressed separately from the frame to be displayed on the local display 6, the additional compression can be performed whilst the compression stage is not (otherwise) in use, e.g., during horizontal or vertical blanking. Alternatively, a second compression stage may be used for the additional compression.

In an alternative embodiment, the second display controller 54 may be replaced with a video encoder, e.g. where the data is to be sent over a network or sent wirelessly.

In various embodiments, the first 52 and second 54 display controllers may be separate display controllers, or may be part of a single dual output display controller (e.g. as discussed above).

It can be seen from the above that embodiments of the technology described herein enable minimization of power consumption within a media sub-system in a system on chip, where multiple video and graphics layers (generated by GPUs and video decoders) need to be fetched from memory and composed.

Furthermore, for dual-display designs, the technology described herein may be used to compose a sophisticated scene in one display processor. This scene may then be scaled (e.g. down) and written back to the memory, to be re-read in by another display controller. As a result, memory bandwidth can be saved, when the same content (but allowing for different resolutions and/or aspect ratio) needs to be displayed on both displays.

The foregoing detailed description has been presented for the purposes of illustration and description. It is not intended to be exhaustive or to limit the technology to the precise form disclosed. Many modifications and variations are possible in the light of the above teaching. The described embodiments were chosen in order to best explain the principles of the technology and its practical application, to thereby enable others skilled in the art to best utilise the technology in various embodiments and with various modifications as are suited to the particular use contemplated. It is intended that the scope be defined by the claims appended hereto.

What is claimed is:

1. A data processing system, comprising:

a main memory;

a first display;

one or more processing units operable to generate input surfaces for display and to store the input surfaces in the main memory; and a first display controller, the first display controller comprising:

input stage circuitry operable to read at least one input surface from the main memory;

processing stage circuitry operable to process one or more read input surfaces to generate an output surface;

output stage circuitry operable to receive the generated output surface directly from the processing stage and to provide the generated output surface for display to the first display, wherein the output stage circuitry is operable to cause the output surface for display to be displayed by the display; and write-out stage circuitry operable to receive the generated output surface or a modified version of the generated output surface directly from the processing stage and to write the generated output surface or the modified version of the generated output surface to the main memory, the first display controller comprises an integrated circuit, the integrated circuit includes the input stage circuitry and the processing stage circuitry, the integrated circuit includes the output stage circuitry and the write-out stage circuitry, the main memory is external to the integrated circuit the data processing system further comprising:

a second display controller comprising:

input stage circuitry operable to read a stored output surface generated by the first display controller from the main memory; and output stage circuitry operable to provide the read output surface to a second display for display.

2. The data processing system of claim 1, wherein the processing stage circuitry comprises composition stage circuitry operable to compose two or more input surfaces to provide a composited output surface;

wherein the output stage circuitry of the first display controller is operable to provide the composited output surface or a modified version of the composited output surface to the first display; and wherein the write-out stage circuitry is operable to write the composited output surface or a modified version of the composited output surface to the main memory.

3. The data processing system of claim 1, wherein the processing stage circuitry comprises scaling stage circuitry operable to scale an input surface and/or an output surface.

4. The data processing system of claim 1, wherein the processing stage circuitry comprises a data flow controller operable to selectively direct the input surfaces and/or output surfaces to other stage circuitry of the display controller.

5. The data processing system of claim 4, wherein the data flow controller is operable to direct one or more input surfaces to composition stage circuitry of the display controller.

6. The data processing system of claim 4, wherein the data flow controller is operable to direct a composited surface to scaling stage circuitry and wherein the scaling stage circuitry is operable to scale the composited surface.

7. The data processing system of claim 4, wherein the data flow controller is operable to direct a composited and/or scaled surface to the write-out stage circuitry and wherein the write-out stage circuitry is operable to write the composited and/or scaled surface to the main memory.

8. The data processing system of claim 1, wherein the processing stage circuitry comprises decoding stage circuitry operable to decode and/or decompress an input surface.

9. The data processing system of claim 1, wherein the processing stage circuitry comprises rotation stage circuitry operable to rotate an input surface.

10. The data processing system of claim 1, wherein the processing stage circuitry comprises post-processing stage circuitry operable to perform one or more processing operations on a composited surface.

11. The data processing system of claim 1, wherein the processing stage circuitry comprises compression stage circuitry operable to compress an input surface and/or an output surface.

12. A method of operating a display controller in a data processing system, the data processing system comprising:

a main memory;

a display;

one or more processing units operable to generate input surfaces for display and to store the input surfaces in the main memory; and a first display controller, the first display controller comprising:

an input stage operable to read at least one input surface from the main memory;

a processing stage operable to process one or more read input surfaces to generate an output surface;

an output stage operable to receive the output surface directly from the processing stage and to provide the output surface to the display for display, wherein the output stage circuitry is operable to cause the output surface for display to be displayed by the display; and a write-out stage operable to receive an output surface directly from the processing stage and to write the output surface to the main memory, the first display controller comprises an integrated circuit, the integrated circuit includes the input stage and the processing stage, the integrated circuit includes the output stage and the write-out stage, the main memory is external to the integrated circuit; and the data processing system further comprising:

a second display controller comprising:

an input stage operable to read the stored output surface from the main memory; and an output stage operable to provide the output surface to a second display for display;

the method comprising:

the first display controller:

reading at least one input surface from the main memory;

processing the at least one input surface to generate an output surface;

providing the generated output surface to the display; and writing the generated output surface or a modified version of the generated output surface to the main memory; and the second display controller reading the generated output surface or the modified version of the generated output surface from the main memory and providing it to the second display for display.

13. The method of claim 12, comprising:

the first display controller compositing two or more input surfaces to generate a composited output surface, writing the composited output surface or a modified version of the composited output surface to the main memory, and providing the composited output surface or a modified version of the composited output surface to the display.

14. The method of claim 12, comprising the first display controller scaling at least one of an input surface and a composited output surface.

15. The method of claim 12, comprising the first display controller decoding and/or decompressing at least one input surface.

16. The method of claim 12, comprising the first display controller rotating at least one input surface.

17. The method of claim 12, comprising the first display controller performing one or more processing operations on a composited output surface before providing it to the display for display.

18. The method of claim 12, comprising the first display controller compressing an input surface and/or an output surface.

19. The method of claim 12, wherein the first display controller downscales the generated output surface that has been provided to the first display to produce a downscaled version of the generated output surface before writing the downscaled version of the generated output surface to the main memory, and the second display controller upscales the downscaled version of the output surface once it has read the downscaled version of the generated output surface from the main memory before providing it to the second display for display.

20. The method of claim 13, comprising the first display controller scaling the composited output surface.

21. The method of claim 12, comprising the write-out stage writing a composited and/or scaled surface to the main memory.

22. The data processing system of claim 3, wherein:

the scaling stage circuitry of the processing stage circuitry is operable to scale the generated output surface to produce a scaled version of the generated output surface; and the write-out stage circuitry is operable to write the scaled version of the generated output surface to the main memory.

23. The data processing system of claim 11, wherein:

the compression stage circuitry of the processing stage circuitry is operable to compress the generated output surface to produce a compressed version of the generated output surface; and the output stage circuitry of the first display controller is operable to provide the compressed version of the generated output surface to the first display; and/or the write-out stage circuitry is operable to write the compressed version of the generated output surface to the main memory.

24. The method of claim 14, comprising:

the first display controller scaling the generated output surface to produce a scaled version of the generated output surface; and the write-out stage writing the scaled version of the generated output surface to the main memory.

25. The method of claim 18, comprising:

the first display controller compressing the generated output surface to produce a compressed version of the generated output surface; and the output stage of the first display controller providing the compressed version of the generated output surface to the display; and/or the write-out stage writing the compressed version of the generated output surface to the main memory.

26. A non-transitory computer readable storage medium storing computer software code which when executing on a processor performs a method of operating a display controller in a data processing system, the data processing system comprising:

a main memory;

a display;

one or more processing units operable to generate input surfaces for display and to store the input surfaces in the main memory; and a first display controller, the first display controller comprising:

an input stage operable to read at least one input surface from the main memory;

a processing stage operable to process one or more read input surfaces to generate an output surface;

an output stage operable to receive the output surface directly from the processing stage and to provide the output surface to the display for display, wherein the output stage circuitry is operable to cause the output surface for display to be displayed by the display; and a write-out stage operable to receive an output surface directly from the processing stage and to write the output surface to the main memory, the first display controller comprises an integrated circuit, the integrated circuit includes the input stage and the processing stage, the integrated circuit includes the output stage and the write-out stage, the main memory is external to the integrated circuit; and the data processing system further comprising:

a second display controller comprising:

an input stage operable to read the stored output surface from the main memory; and an output stage operable to provide the output surface to a second display for display;

the method comprising:

the first display controller:

reading at least one input surface from the main memory;

processing the at least one input surface to generate an output surface;

providing the generated output surface to the display; and writing the generated output surface or a modified version of the generated output surface to the main memory; and the second display controller reading the generated output surface or the modified version of the generated output surface from the main memory and providing it to the second display for display.

* * * * *